US007518589B2

(12) United States Patent
Takeda

(10) Patent No.: US 7,518,589 B2
(45) Date of Patent: Apr. 14, 2009

(54) LIQUID CRYSTAL DISPLAY DEVICE AND METHOD FOR DRIVING THE SAME

(75) Inventor: Hiroshi Takeda, Kawasaki (JP)

(73) Assignee: NEC LCD Technologies, Ltd., Kawasaki-Shi (JP)

( * ) Notice: Subject to any disclaimer, the term of this patent is extended or adjusted under 35 U.S.C. 154(b) by 629 days.

(21) Appl. No.: 11/071,211

(22) Filed: Mar. 4, 2005

(65) Prior Publication Data

US 2005/0195141 A1 Sep. 8, 2005

(30) Foreign Application Priority Data

Mar. 5, 2004 (JP) ..... 2004-063281

(51) Int. Cl.
*G09G 3/36* (2006.01)

(52) U.S. Cl. ..... 345/98; 345/87; 345/89; 345/104

(58) Field of Classification Search ..... 345/1.3, 345/87–89, 1.1, 530, 660, 173, 92, 98–105, 345/1, 204, 690, 94, 84, 212–214, 7, 31, 345/83, 531, 545, 694; 348/731, 671, 383; 365/194, 233; 349/73; 324/770
See application file for complete search history.

(56) References Cited

U.S. PATENT DOCUMENTS 5,079,636 A * 1/1992 Brody ..... 348/383
5,202,675 A * 4/1993 Tokimoto et al. ..... 345/31
5,534,892 A * 7/1996 Tagawa ..... 345/173
5,896,116 A * 4/1999 Torizuka et al. ..... 345/87
6,271,825 B1 * 8/2001 Greene et al. ..... 345/694
6,292,157 B1 * 9/2001 Greene et al. ..... 345/1.3
6,362,643 B1 * 3/2002 Kim ..... 324/770
6,369,867 B1 * 4/2002 Ge ..... 349/73
6,486,890 B1 * 11/2002 Harada et al. ..... 345/660
6,577,287 B2 * 6/2003 Havel ..... 345/83
6,825,845 B2 * 11/2004 Nally ..... 345/545
6,999,045 B2 * 2/2006 Cok ..... 345/1.3
7,030,871 B2 * 4/2006 Kitagawa et al. ..... 345/213
7,227,522 B2 * 6/2007 Fujimoto et al. ..... 345/87
7,245,281 B2 * 7/2007 Sekido et al. ..... 345/87
2002/0080107 A1 * 6/2002 Fujimoto et al. ..... 345/87

(Continued)

FOREIGN PATENT DOCUMENTS

CN 1475838 A 2/2004

(Continued)

*Primary Examiner*—Prabodh M Dharia
(74) *Attorney, Agent, or Firm*—Young & Thompson

(57) ABSTRACT

A liquid crystal display device having two pieces of liquid crystal display panels commonly using a source driver is provided which is capable of displaying a different image in each of the two pieces of liquid crystal display panels. The liquid crystal display device includes the two liquid crystal display panels commonly using drain lines, a timing controller to control outputting timing of an image data signal for each liquid crystal display panel, a source driver to output image data, gate line by gate line, to a plurality of drain lines for each liquid crystal display panel, and gate drivers to sequentially output gate driving pulses to gate lines for each liquid crystal display panel according to a signal to provide instructions for a staff of outputting of an image data signal and to a signal to control an inputting period of image data in every line.

12 Claims, 8 Drawing Sheets

U.S. PATENT DOCUMENTS

2002/0118321 A1* 8/2002 Ge ..... 349/73
2003/0030607 A1* 2/2003 Kitagawa et al. ..... 345/87
2003/0038765 A1* 2/2003 Hiraki ..... 345/87
2003/0184550 A1* 10/2003 Nally ..... 345/531
2004/0008155 A1* 1/2004 Cok ..... 345/1.3
2004/0169618 A1* 9/2004 Nakai et al. ..... 345/1.1
2006/0214896 A1* 9/2006 Yamada et al. ..... 345/88
2007/0210982 A1* 9/2007 Nakai et al. ..... 345/1.1
2007/0291041 A1* 12/2007 Nakai et al. ..... 345/530

FOREIGN PATENT DOCUMENTS

JP 9-236801 9/1997
JP 2001-312228 11/2001
JP 2002-357845 12/2002
JP 2003-177683 6/2003
JP 2003-280541 10/2003

* cited by examiner

LIQUID CRYSTAL DISPLAY DEVICE AND METHOD FOR DRIVING THE SAME

BACKGROUND OF THE INVENTION

1. Field of the Invention

The present invention relates to a liquid crystal display device capable of simultaneously displaying different images by using a plurality of liquid crystal display panels commonly using drain lines and a method for driving the above liquid crystal display device.

The present application claims priority of Japanese Patent Application No. 2004-063281 filed on Mar. 5, 2004, which is hereby incorporated by reference.

2. Description of the Related Art

A conventional liquid crystal display device is disclosed in, for example, Japanese Patent Application Laid-open No. 2001-312228 in which a plurality of different images is simultaneously displayed on one piece of a liquid crystal display panel. The conventional liquid crystal display device has configurations and uses its driving method so that one piece of the liquid crystal display panel is divided into two displaying areas, one for a front displaying area and another for a rear displaying area to display images on both the front and rear of the one piece of the liquid crystal display panel and, by commonly using a part or an entire of a wiring drawn from a liquid crystal driver IC (Integrated Circuit), to display an image on both the front and rear displaying areas, the number of pixels that can be displayed by the liquid crystal driver IC is increased.

Also, another conventional liquid crystal display device is disclosed in Japanese Patent Application Laid-open No. 2002-357845 which is so configured that a plurality of liquid crystal display panels commonly uses peripheral circuits including an LSI (Large Scale Integrated Circuit) for driving a liquid crystal display panel to enable component counts to be reduced and liquid crystal display devices to be made small and thin.

Also, still another conventional liquid crystal display device is disclosed in Japanese Patent Application Laid-open No. 2003-177683 in which a display media having a front side display panel and a rear side display panel is provided and a signal electrode and a scanning electrode are mounted on each of the front side display panel and rear side display panel and the signal electrodes on both the front side display panel and rear side display panel are electrically connected to a same signal electrode driving IC, thus reducing the number of the driving ICs to achieve a miniaturized and simplified double-faced display medium.

Also, still another conventional liquid crystal display device is disclosed in Japanese Patent Application Laid-open No. 2003-280541 in which, by interposing a driver IC between two liquid crystal display panels, an electro-optical device that can achieve reduction in component counts required for double-face displaying and in component mounting processes is provided.

Furthermore, still another conventional liquid crystal display device is disclosed in Japanese Patent Application Laid-open No. Hei09-236801 in which, by irradiating two pieces of liquid crystal display elements with light using a common irradiating means and by driving the two pieces of liquid crystal display elements using a common driving IC, component counts are reduced and simultaneous display on both the front and rear of the liquid crystal display element is made possible.

However, each of the above conventional liquid crystal display devices disclosed above has a problem.

In the liquid crystal display device disclosed in Japanese Patent Application Laid-open No. 2001-312228, an independent control on a common wiring or a segment wiring in the front display area and in the rear display area is impossible. As a result, normal display can be made in only either of the front display area or the rear display area and cannot be made simultaneously both in the front and rear display areas. Also, in this conventional technology, though a construction is described in which only either of the common wiring or segment wiring is commonly operated, since a case in which both the front and rear display areas are seen simultaneously by a user is not expected, a driving method for enabling simultaneous normal display on both the front and rear display areas is not proposed.

Also, in the patent reference disclosed as Japanese Patent Application Laid-open No. 2003-177683, a description about the technology is not made in which, in the double-faced display medium, the signal electrode and scanning electrode are formed in each of the front side display panel and the rear side display panel and the signal electrodes both on the front and rear side display panels are operated by the same signal electrode driving IC. However, no description is made about the technology by which different images are simultaneously displayed on a plurality of liquid crystal display panels using common drain lines.

Moreover, in each of the patent references other than described above, no description is made about the technology by which different images can be made simultaneously in a plurality of liquid crystal display panels configured so as to have the common drain lines.

Thus, in the conventional technologies, when a plurality of liquid crystal display panels using common drain lines is to be seen simultaneously, different image contents cannot be displayed in the plurality of liquid crystal display panels.

SUMMARY OF THE INVENTION

In view of the above, it is an object of the present invention to provide a liquid crystal display device and a method for driving the liquid crystal display device which enable simultaneous display of different images on each of a plurality of liquid crystal display panels using common drain lines.

According to a first aspect of the present invention, there is provided a liquid crystal display device including:

a plurality of liquid crystal display panels commonly using drain lines;

a timing controller to control outputting timing of a plurality of image data signals, the image data signals each being fed to a corresponding one of the plurality of liquid crystal display panels;

a source driver to output image data, gate line by gate line, to a plurality of drain lines connected to the plurality of liquid crystal display panels according to output timing control exercised by the timing controller; and a plurality of gate drivers each corresponding to one of the plurality of liquid crystal display panels, the gate drivers each outputting sequentially gate driving pulses to a plurality of the gate lines connected to the corresponding liquid crystal display panel according to inputting of first and second signals, the first signal providing instructions for a start of outputting of the corresponding image data signal, which is transmitted from the timing controller, to be fed to the corresponding liquid crystal display panel, and the second signal controlling an inputting period of the gate line-by-gate line image data, which makes up the corresponding image data signal;

wherein a plurality of the gate line-by-gate line image data, which makes up the plurality of image data signals, each is sequentially switched in order of inputting of the plurality of the gate line-by-gate line image data and is output to the corresponding drain line connected to the corresponding liquid crystal display panel.

According to a second aspect of the present invention, there is provided a liquid crystal display device including:

a plurality of liquid crystal display panels commonly using drain lines;

a timing controller to control outputting timing of a plurality of image data signals, the image data signals each being fed to a corresponding one of the plurality of liquid crystal display panels;

a source driver to output image data, gate line by gate line, to a plurality of drain lines connected to the plurality of liquid crystal display panels according to output timing control exercised by the timing controller; and a plurality of gate drivers each corresponding to one of the plurality of liquid crystal display panels, the gate drivers each outputting sequentially gate driving pulses to a plurality of the gate lines connected to the corresponding liquid crystal display panel according to inputting of first and second signals, the first signal, which is fed sequentially to the plurality of gate drivers in a cascaded manner, providing instructions for a start of outputting of the corresponding image data signal, which is transmitted from the timing controller, to be fed to the corresponding liquid crystal display panel, and the second signal, which is fed to the plurality of gate drivers in a parallel manner, controlling an inputting period of frame by frame image data, which makes up the corresponding image data signal;

wherein a plurality of the frame-by-frame image data, which makes up the plurality of image data signals, each is sequentially switched in order of inputting of the plurality of the frame-by-frame image data and is output to the drain lines connected to the corresponding liquid crystal display panel.

According to a third aspect of the present invention, there is provided a liquid crystal display device including:

a plurality of liquid crystal display panels commonly using drain lines;

a timing controller to control outputting timing of a plurality of image data signals, the image data signals each being fed to a corresponding one of the plurality of liquid crystal display panels;

a source driver to output image data, gate line by gate line, to a plurality of drain lines connected to the plurality of liquid crystal display panels according to output timing control exercised by the timing controller; and a gate driver being commonly used by the plurality of liquid crystal display panels and outputting sequentially gate driving pulses to a plurality of the gate lines connected to a designated liquid crystal display panel according to inputting of first, second, and third signals, the first signal providing instructions for a start of outputting of the corresponding image data signal, which is transmitted from the timing controller, to be fed to the corresponding liquid crystal display panel, the second signal controlling an inputting period of the gate line-by-gate line image data, which makes up the corresponding image data signal, the third signal designating one of the plurality of liquid crystal display panels as liquid crystal display panel the to which the image data is output;

wherein a plurality of the gate line-by-gate line image data, which makes up the plurality of image data signals, each is sequentially switched in order of inputting of the plurality of the gate line-by-gate line image data and is output to the corresponding drain line connected to the corresponding liquid crystal display panel.

According to a fourth aspect of the present invention, there is provided a liquid crystal display device including:

a plurality of liquid crystal display panels commonly using drain lines;

a timing controller to control outputting timing of a plurality of image data signals, the image data signals each being fed to a corresponding one of the plurality of liquid crystal display panels;

a source driver to output image data, gate line by gate line, to a plurality of drain lines connected to the plurality of liquid crystal display panels according to output timing control exercised by the timing controller; and a gate driver being commonly used by the plurality of liquid crystal display panels and outputting sequentially gate driving pulses to a plurality of the gate lines connected to a designated liquid crystal display panel according to inputting of first, second, and third signals, the first signal providing instructions for a start of outputting of the corresponding image data signal, which is transmitted from the timing controller, to be fed to the corresponding liquid crystal display panel, the second signal controlling an inputting period of the frame-by-frame image data, which makes up the corresponding image data signal, the third signal designating one of the plurality of liquid crystal display panels as liquid crystal display panel the to which the image data is output;

wherein a plurality of the frame-by-frame image data, which makes up the plurality of image data signals, each is sequentially switched in order of inputting of the plurality of the frame-by-frame image data and is output to the drain lines connected to the corresponding liquid crystal display panel.

According to a fifth aspect of the present invention, there is provided a method for driving a liquid crystal display device including: a plurality of liquid crystal display panels commonly using a plurality of drain lines, and a plurality of gate drivers each corresponding to one of the plurality of liquid crystal display panels, and controlling a plurality of the gate lines connected to the corresponding liquid crystal display panel, the method including the steps of:

outputting image data beginning with head data, gate line by gate line, to the plurality of drain lines connected to the plurality of liquid crystal display panels, in a manner to control so as to be input sequentially to the corresponding liquid crystal display panel in an inputting period of the number of the gate lines being equal to the number of the plurality of liquid crystal display panels; and outputting sequentially gate driving pulses to the plurality of the gate lines of the plurality of liquid crystal display panels; and wherein a plurality of the gate line-by-gate line image data, which makes up a plurality of image data signals, each is sequentially switched in order of inputting of the plurality of the gate line-by-gate line image data and is output to the corresponding drain line connected to the corresponding liquid crystal display panel.

According to a sixth aspect of the present invention, there is provided a method for driving a liquid crystal display device including: a plurality of liquid crystal display panels that uses drain lines commonly, and a plurality of gate drivers being cascaded, the gate drivers each corresponding to one of the plurality of liquid crystal display panels, and controlling a plurality of the gate lines connected to the corresponding liquid crystal display panel, the method including the steps of:

outputting image data beginning with head data, frame by frame, to the plurality of drain lines connected to the plurality of liquid crystal display panels, in a manner to control a plurality of image data so as to be input sequentially to the corresponding liquid crystal display panel in one line period; and outputting sequentially gate driving pulses to the plurality of the gate lines of the plurality of liquid crystal display panels in a cascaded manner; and wherein a plurality of the frame-by-frame image data, which makes up the plurality of image data signals, each is sequentially switched in order of inputting of the plurality of the frame-by-frame image data and is output to the drain lines connected to the corresponding liquid crystal display panel.

According to a seventh aspect of the present invention, there is provided a method for driving a liquid crystal display device including: a plurality of liquid crystal display panels commonly using a plurality of drain lines, and a gate driver being commonly used by the plurality of liquid crystal display panels, and controlling a plurality of the gate lines connected to the plurality of liquid crystal display panels, the method including the steps of:

outputting image data beginning with head data, gate line by gate line, to the plurality of drain lines connected to the plurality of liquid crystal display panels, in a manner to control so as to be input sequentially to the corresponding liquid crystal display panel in an inputting period of the number of the gate lines being equal to the number of the plurality of liquid crystal display panels;

designating one of the plurality of liquid crystal display panels as liquid crystal display panel the to which the image data is output; and outputting sequentially gate driving pulses to the plurality of the gate lines of the designated liquid crystal display panels; and wherein a plurality of the gate line-by-gate line image data, which makes up a plurality of image data signals, each is sequentially switched in order of inputting of the plurality of the gate line-by-gate line image data and is output to the corresponding drain line connected to the corresponding liquid crystal display panel.

According to an eighth aspect of the present invention, there is provided a method for driving a liquid crystal display device including: a plurality of liquid crystal display panels commonly using a plurality of drain lines, and a gate driving means being commonly used by the plurality of liquid crystal display panels, and controlling a plurality of the gate lines connected to the plurality of liquid crystal display panels, the method including the steps of:

outputting image data beginning with head data, frame by frame, to the plurality of drain lines connected to the plurality of liquid crystal display panels, in a manner to control a plurality of image data so as to be input sequentially to the corresponding liquid crystal display panel in one line period;

designating one of the plurality of liquid crystal display panels as liquid crystal display panel the to which the image data is output; and outputting sequentially gate driving pulses to the plurality of the gate lines of the designated liquid crystal display panels; and wherein a plurality of the frame-by-frame image data, which makes up the plurality of image data signals, each is sequentially switched in order of inputting of the plurality of the frame-by-frame image data and is output to the drain lines connected to the corresponding liquid crystal display panel.

With the above configurations, even when a plurality of liquid crystal display panels using commonly drain lines is seen simultaneously, different image contents can be displayed in each of the plurality of liquid crystal display panels.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

According to the best mode of the present invention, a liquid crystal display device is provided with a plurality of liquid crystal display panels commonly using drain lines, a timing controller unit controls outputting timing of a plurality of image data signals, the image data signals each being fed to a corresponding one of the plurality of liquid crystal display panels. A source driver unit outputs image data, gate line by gate line, to a plurality of drain lines connected to the plurality of liquid crystal display panels according to output timing control exercised by the timing controller. Also, A plurality of gate driver units each correspond to one of the plurality of liquid crystal display panels, the gate drivers each outputting sequentially gate driving pulses to a plurality of the gate lines connected to the corresponding liquid crystal display panel according to inputting of first and second signals, the first signal providing instructions for a start of outputting of the corresponding image data signal, which is transmitted from the timing controller, to be fed to the corresponding liquid crystal display panel, and the second signal controlling an inputting period of the gate line-by-gate line image data, which makes up the corresponding image data signal.

A plurality of the gate line-by-gate line image data, which makes up the plurality of image data signals, each is sequentially switched in order of inputting of the plurality of the gate line-by-gate line image data and is output to the corresponding drain line connected to the corresponding liquid crystal display panel.

First Embodiment

Figure 1:
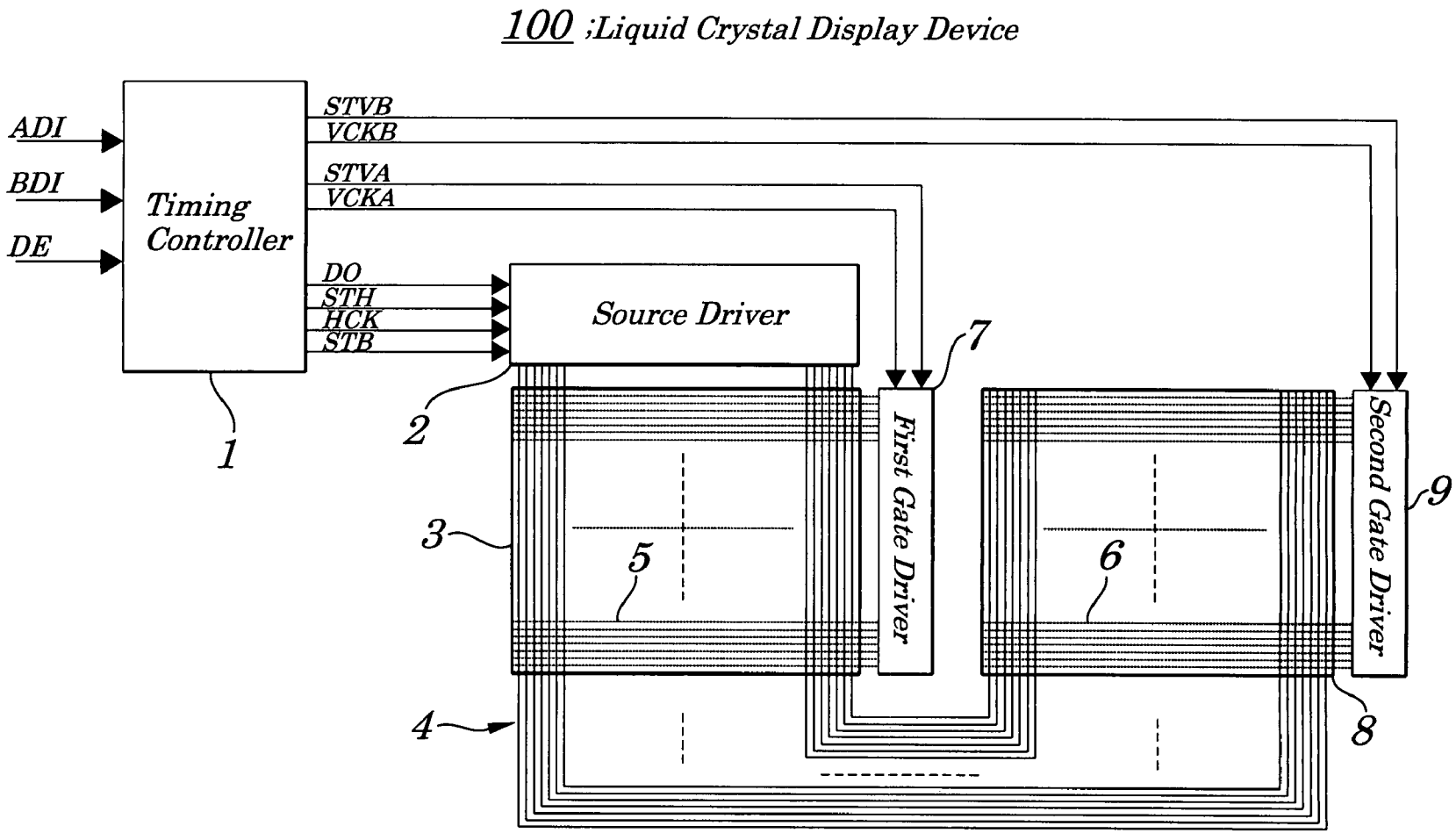
FIG. 1 is a diagram showing configurations of a liquid crystal display device according to a first embodiment of the present invention.
Figure 2:
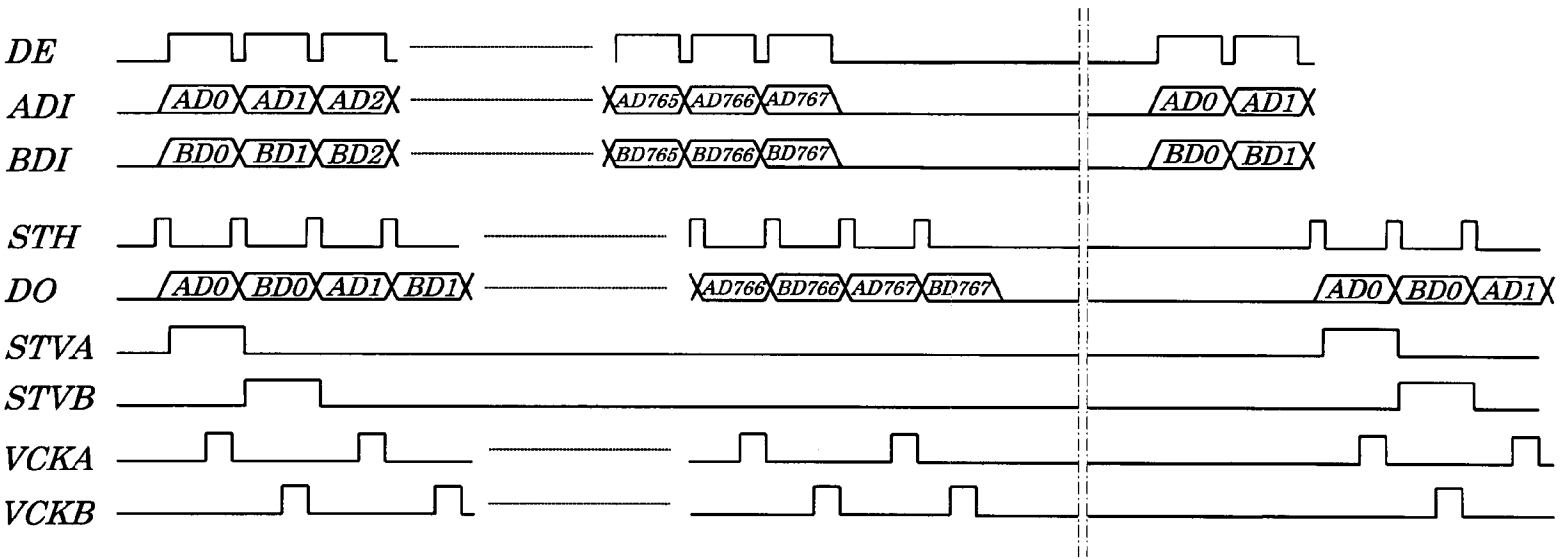
FIG. 2 is a timing chart explaining operations of the liquid crystal display device according to the first embodiment of the present invention.

FIG. 1 is a diagram for showing configurations of a liquid crystal display device 100 according a first embodiment of the present invention. FIG. 2 is a timing chart for explaining operations of the liquid crystal display device 100 according to the first embodiment.

The liquid crystal display device 100 of the embodiment, as shown in FIG. 1, chiefly includes a timing controller 1, a source driver 2, a first liquid crystal display panel 3, drain lines 4, first gate lines 5, second gate lines 6, a first gate driver 7, a second liquid crystal display panel 8, and a second gate driver 9.

To the timing controller 1 are input an image data signal ADI to display an image on the first liquid crystal display panel 3, an image data signal BDI to display an image on the second liquid crystal display panel 8, and a synchronizing signal such as a data enable signal DE, or a like. The timing controller 1 outputs an image data signal DO, start pulse signal STH, shift clock signal HCK, and data latch signal STB all being used as a control signal for the source driver 2, each being produced from the above input signals. Also, the timing controller 1 outputs a start pulse signal STVA and shift clock signal VCKA both being used as a control signal for the first gate driver 7 and outputs a start pulse signal STVB and a shift clock signal VCKB, both being used as a control signal for the second gate driver 9.

In the liquid crystal display device 100 of the first embodiment, the timing controller 1 controls the image data signal DO so as to output the image data signal ADI and image data signal BDI to the drain lines 4 alternately for every line period and controls the first gate driver 7 and second gate driver 9 in synchronization with the timing with which the image data signal DO is controlled and, as a result, different image contents can be displayed even when the first liquid crystal display panel 3 and second liquid crystal display panel 8 commonly using the drain lines 4 are seen simultaneously.

Next, operations of the liquid crystal display device 100 of the first embodiment are explained by referring to FIG. 2. FIG. 2 shows operations of the liquid crystal display device 100 of the first embodiment by using timing with which two pieces of liquid crystal display panels each providing 1024×768 resolution display images.

In the data enable signal DE shown in FIG. 2, an "L" (Low) period represents an INVALID period and an "H" (High) period represents a VALID period. The image data signal ADI is a signal used to display an image on the first liquid crystal display panel 3. An AD0 represents a signal for image data on a first line, an AD1 represents a signal for image data on a second line, and an AD2 represents a signal for image data on a third line. Thereafter, similarly, an AD767 represents a signal for image data on a 768-th line. Also, The image data signal BDI is a signal used to display an image on the second liquid crystal display panel 8. A BD0 represents a signal for image data on a first line, a BD1 represents a signal for image data on a second line, and a BD2 represents a signal for image data on a third line. Thereafter, similarly, a BD767 represents a signal for image data on a 768-th line.

The image data signal DO is controlled by the timing controller 1 so that image data AD0 to AD767 for the first liquid crystal display panel 3 and image data BD0 to BD767 for the second liquid crystal display panel 8 are output alternately. The source driver 2 outputs image data to the drain lines 4, according to the input image data signal DO, in the order of AD0→BD0→AD1→BD1→, . . . , → AD766→BD766→AD767→BD767.

The timing controller 1, in order to realize correct displaying of image data AD0→BD0→AD1→BD1→, . . . , → AD766→BD766→AD767→BD767 all being output from the source driver 2 to the drain lines 4, on each of the first liquid crystal display panel 3 and second liquid crystal display panel 8, generates respectively the start pulse signal STVA so that the image data AD0 is head data and the start pulse signal STVB so that the image data BD0 is head data, and further generates the shift clock signal VCKA in synchronization with the start pulse signal STVA for every two line periods, and the shift clock signal VCKB in synchronization with the start pulse signal STVB for every two line periods.

Then, by the start pulse signal STVA and shift clock signal VCKA input to the first gate driver 7 and by the start pulse signal STVB and shift clock signal VCKB input to the second gate driver 9, a gate driving pulse is alternately output to the first gate line 5 and the second gate line 6. By exercising the control as above, the first liquid crystal display panel 3 and the second liquid crystal display panel 8, by commonly using the source driver 2 and drain lines 4, can display different images in each of the first and second liquid crystal display panels 3 and 8 at the same time.

Thus, according to the liquid crystal display device 100 of the first embodiment, in each of the first liquid crystal display panel 3 and the second liquid crystal display panel 8, though these two liquid crystal display panels 3 and 8 commonly use the source driver 2 and drain lines 4, simultaneous display of two different images in each of the two liquid crystal display panels 3 and 8 is made possible.

Second Embodiment

Figure 3:
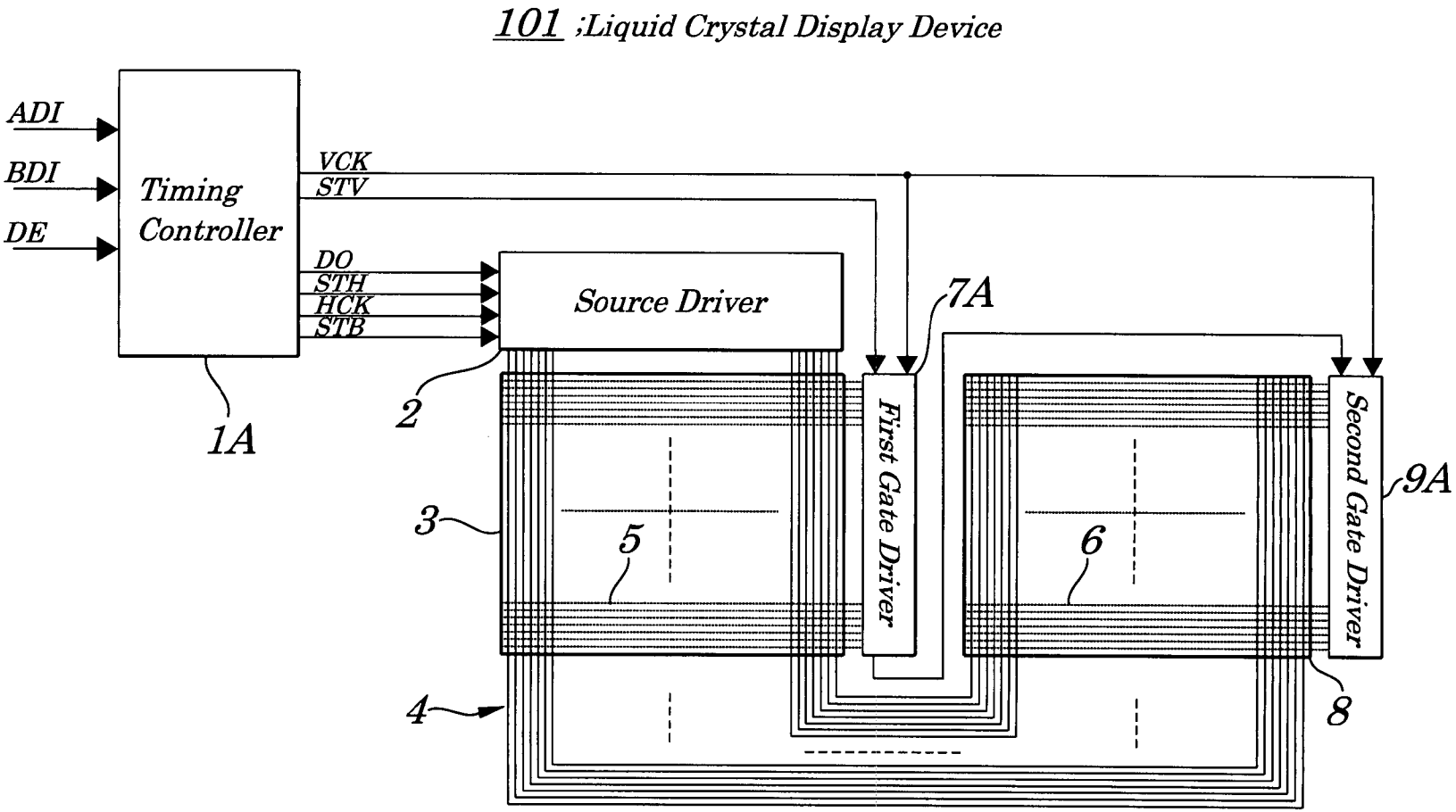
FIG. 3 is a diagram showing configurations of a liquid crystal display device according to a second embodiment of the present invention.
Figure 4:
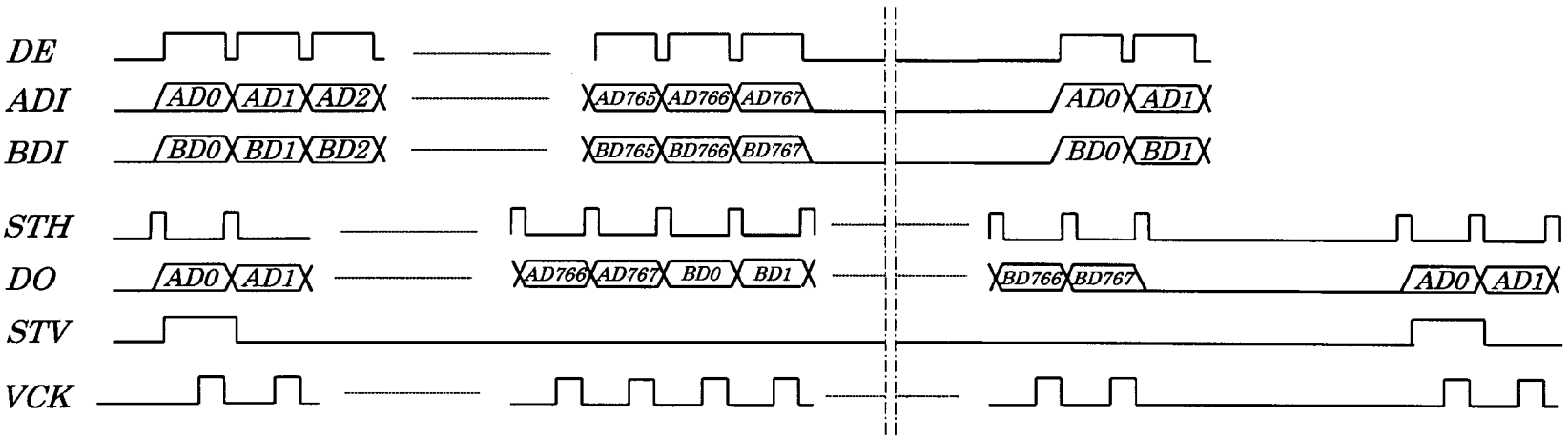
FIG. 4 is a timing chart explaining operations of the liquid crystal display device according to the second embodiment of the present invention.

FIG. 3 is a diagram for showing configurations of a liquid crystal display device 101 according to a second embodiment of the present invention. FIG. 4 is a timing chart for explaining operations of the liquid crystal display device 101 according to the second embodiment. In the first embodiment shown in FIGS. 1 and 2, a driving method is employed by which image data is alternately written in every one line in first and second liquid crystal display panels 3 and 8. However, in the second embodiment, a driving method is used by which image data is alternately written in every frame period in the first and second liquid crystal display panels 3 and 8.

The liquid crystal display device 101 of the second embodiment, as shown in FIG. 3, chiefly includes a timing controller 1A, a source driver 2, a first liquid crystal display panel 3, drain lines 4, first gate lines 5, second gate lines 6, a first gate driver 7A, a second liquid crystal display panel 8, and a second gate driver 9A. Out of these components, the source driver 2, first liquid crystal display panel 3, drain lines 4, first gate lines 5, second gate lines 6, and second liquid crystal display panel 8 have the same configurations and functions as those in the first embodiment shown in FIG. 1.

The first gate driver 7A and second gate driver 9A are cascaded. To the timing controller 1A are input an image data signal ADI to display an image on the first liquid crystal display panel 3, an image data signal BDI to display an image on the second liquid crystal display panel 8, and a synchronizing signal such as a data enable signal DE, or a like. The timing controller 1A also outputs, by using these input signals, an image data signal DO, start pulse signal STH, shift clock signal HCK, and data latch signal STB all being used as a control signal of the source driver 2, and a data latch signal STB and start pulse signal STV and shift clock signal VCK all being used as a control signal of the first gate driver 7A and the second gate driver 9A. The start pulse signal STV is fed to the first gate drain 7A and second gate drain 9A in a cascaded manner.

By configuring as above, the timing controller 1A controls the image data signal DO so as to output the image data signal ADI and image data signal BDI to the drain lines 4 consecutively and alternately for every frame period and to control the first gate driver 7A and second gate driver 9A in synchronization with the timing with which the image data signal DO is controlled and, as a result, different image contents can be displayed even when the first liquid crystal display panel 3 and second liquid crystal display panel 8 commonly using the drain lines 4 are seen at the same time.

Next, operations of the liquid crystal display device 101 of the second embodiment are explained by referring to FIG. 4. FIG. 4 shows operations of the liquid crystal display device 101 of the second embodiment by using timing with which two pieces of liquid crystal display panels each providing 1024×768 resolution display images. The timing controller 1A, as shown in FIG. 4, controls the image data signal DO so that image data AD0 to AD767 to be used in the first liquid crystal display panel 3 and image data BD0 to BD767 to be used in the second liquid crystal display panel 8 are output consecutively. The source driver 2, by the input image data signal DO, outputs image data in the order of AD0→AD1→, . . . , →AD766→AD767→BD0→BD1→, . . . , →BD766→BD767 to the drain lines 4.

The timing controller 1A, in order to realize correct displaying of image data AD0→AD1→, . . . , →AD766→AD767→BD0→BD1→, . . . , →BD766→BD767 all being output from the source drain driver 2 to the drain lines 4 on each of the first liquid crystal display panel 3 and the second liquid crystal display panel 8, generates a start pulse signal STV so that the image data AD0 is a head of data to be displayed in the first liquid crystal display panel 3 and so that the image data BD0 is a head of data to be displayed in the second liquid crystal display panel 8, and generates a shift clock signal VCK in every one line.

Then, by the start pulse signal STV and shift clock signal VCK both having been input to the first gate driver 7A and by the start pulse signal STV and shift clock signal VCK both having been input, in a cascade manner, from the first gate driver 7A to the second gate driver 9A, after a gate driving pulse has been output to the gate line 5, the gate driving pulse is output to the gate lines 6.

By exercising the control as above, the first liquid crystal display panel 3 and the second liquid crystal display panel 8, by commonly using the source driver 2 and drain lines 4, can display different images in each of the first and second liquid crystal display panels 3 and 8 at the same time.

Thus, according to the liquid crystal display device 101 of the second embodiment, in each of the first liquid crystal display panel 3 and the second liquid crystal display panel 8, though these two liquid crystal display panels 3 and 8 commonly use the source driver 2 and drain lines 4, simultaneous display of two images in each of the two liquid crystal display panels 3 and 8 is made possible.

Third Embodiment

Figure 5:
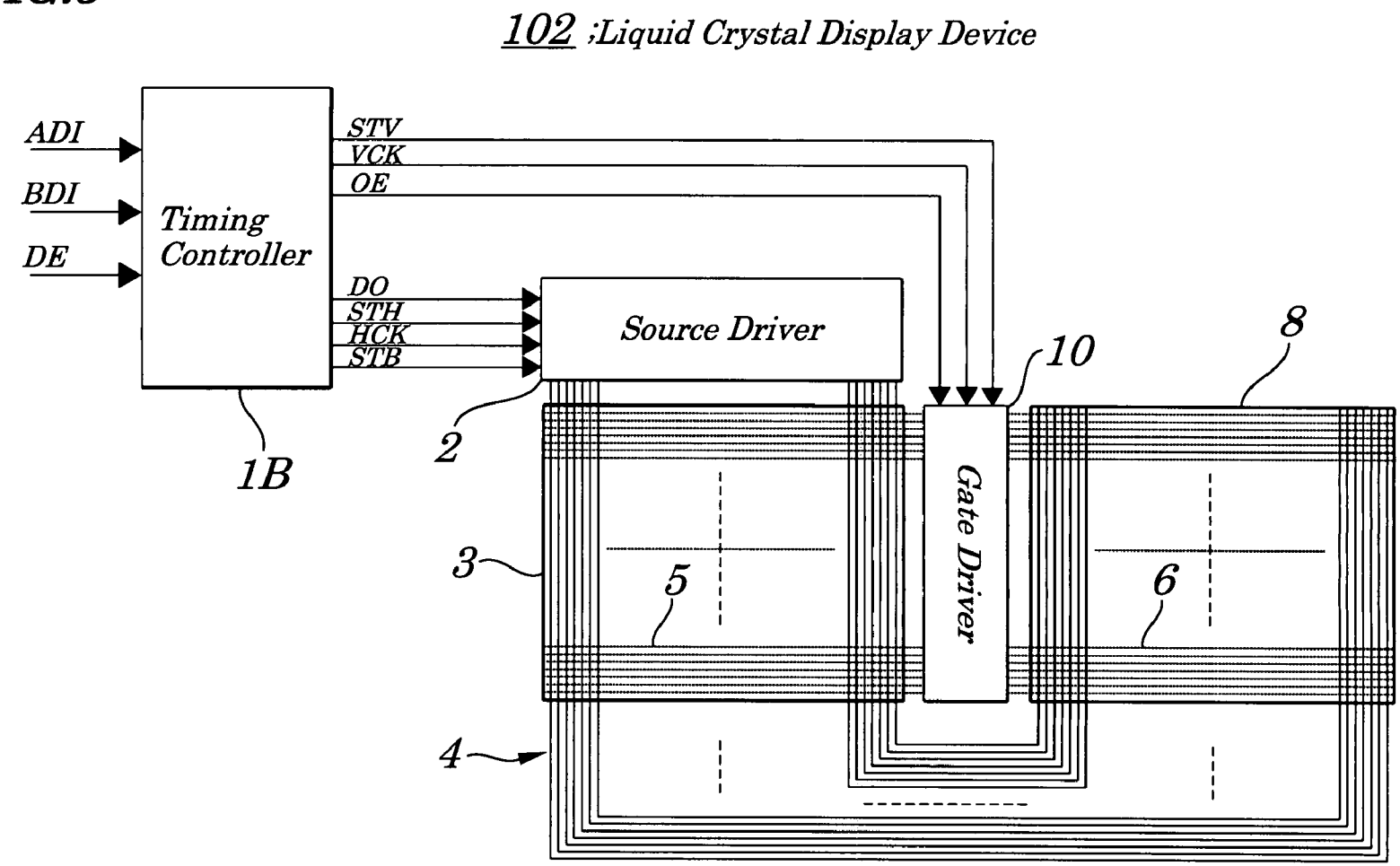
FIG. 5 is a diagram showing configurations of a liquid crystal display device according to a third embodiment of the present invention.
Figure 6:
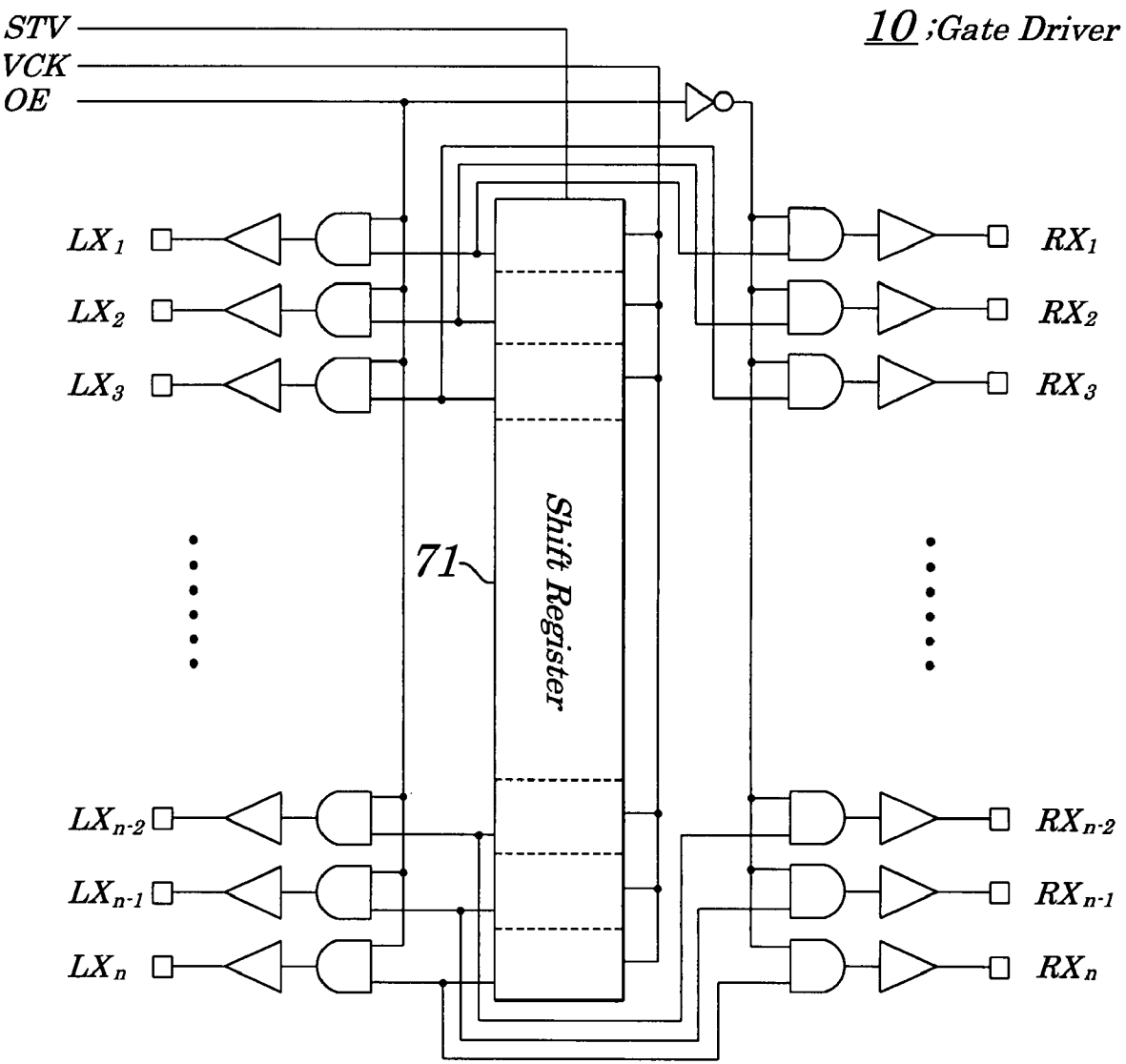
FIG. 6 is a diagram showing configurations of a gate driver according to the third embodiment of the present invention.
Figure 7:
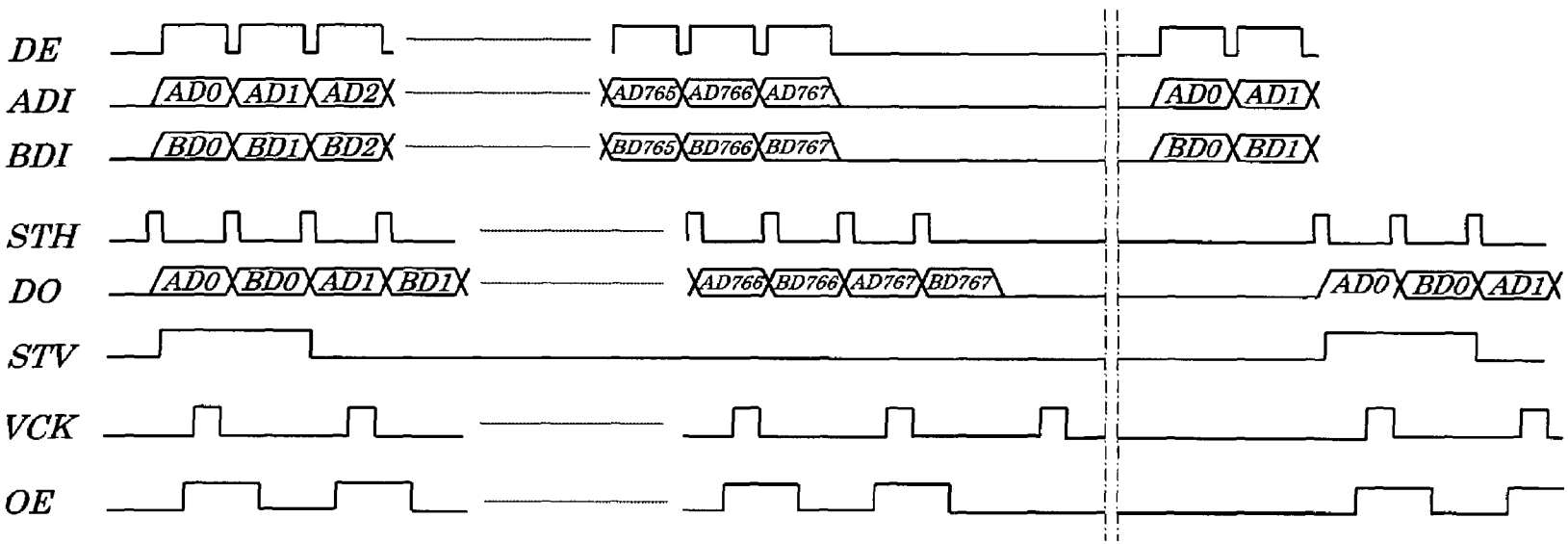
FIG. 7 is a timing chart explaining operations of the liquid crystal display device according to the third embodiment of the present invention.

FIG. 5 is a diagram for showing configurations of a liquid crystal display device 102 according to a third embodiment of the present invention. FIG. 6 is a diagram for showing configurations of a gate driver 10 employed in the liquid crystal display device 102 shown in FIG. 5. FIG. 7 is a timing chart for explaining operations of the liquid crystal display device 102 according to the third embodiment.

In the first embodiment shown in FIGS. 1 and 2 and in the second embodiment shown in FIGS. 3 and 4, the first liquid crystal display panel 3 is so configured as to have the first gate driver 7 (7A), and the second liquid crystal display panel 8 is so configured as to have the second gate driver 9 (9A) . However, in the third embodiment shown in FIGS. 5, 6, and 7, first and second liquid crystal display panels 3 and 8 commonly use the gate driver 10. That is, the liquid crystal display device 102 of the third embodiment shown in FIG. 5 chiefly includes a timing controller 1B, a source driver 2, the first liquid crystal display panel 3, drain lines 4, first gate lines 5, second gate lines 6, the second liquid crystal display panel 8, and the gate driver 10. Out of these components, the source driver 2, first liquid crystal display panel 3, drain lines 4, first gate lines 5, second gate lines 6, and second liquid crystal display panel 8 have the same configurations and functions as those in the first embodiment shown in FIG. 1. The gate driver 10 operates to drive both the first and second gate lines 5 and 6.

To the timing controller 1B are input an image data signal ADI to display an image on the first liquid crystal display panel 3, an image data signal BDI to display an image on the second liquid crystal display panel 8, and a synchronizing signal such as a data enable signal DE, or a like. The timing controller 1B outputs, by using these input signals, an image data signal DO, start pulse signal STH, shift clock signal HCK, and data latch signal STB all being used as a control signal of the source driver 2, and a start pulse signal STV and shift clock signal VCK, and an output enable signal OE all being used as a control signal of the gate driver 10.

The gate driver 10, as shown in FIG. 6, can output gate driving pulses $LX_1$, $LX_2$, . . . , $LX_{n-1}$, and $LX_n$ and gate driving pulses $RX_1$, $RX_2$, . . . , $RX_{n-1}$, and $RX_n$ ("n" denotes the number of the gate lines 5 and 6) , by using a shift register 71 commonly, to which the start pulse signal STV and the shift clock signal VCK are input, to the first liquid crystal display panel 3 (on the left side in FIG. 6) and the second liquid crystal display panel 8 (on the right side in FIG. 6), and can exercise control on which liquid crystal display panel, the left or the right, is to receive such pulses according to the output enable signal OE.

In the liquid crystal display device 102 of the third embodiment, the source driver 2 is controlled according to the image data signal DO input thereto so as to output the image data signal ADI and the image data signal BDI alternately for every line period to the drain lines 4, and the gate driver 10 is also controlled in synchronization with the timing with which the image data signal DO is controlled and, as a result, different image contents can be displayed even when the first liquid crystal display panel 3 and second liquid crystal display panel 8 commonly using the drain lines 4 are seen at the same time.

Next, operations of the liquid crystal display device 102 of the third embodiment are explained by referring to FIG. 7. FIG. 7 shows operations of the liquid crystal display device 102 of the third embodiment by using timing with which two pieces of liquid crystal display panels each providing 1024×768 resolution display images. The timing controller 1B, as shown in FIG. 7, controls the image data signal DO so that image data AD0 to AD767 to be used in the first liquid crystal display panel 3 and image data BD0 to BD767 to be used in the second liquid crystal display panel 8 are output alternately on every line. The source driver 2, when receiving the input image data signal DO, outputs image data in the order of AD0→BD0→AD1→BD1, . . . , →AD766→BD766→AD767→BD767 to the drain lines 4.

In order to realize correct displaying of the gate line-by-gate line image data AD0→BD0→AD1→BD1, . . . , →AD766→BD766→AD767→BD767 all being output from the source driver 2 to the drain lines 4, on each of the first liquid crystal display panel 3 and second liquid crystal display panel 8, control is exercised so that the shift clock signal VCK is produced for every two line periods and a logical value of the output enable signal OE in every one line period is reversed. Then, the gate driver 10, when receiving the shift clock signal VCK and the out put enable signal OE, as shown in FIG. 6, outputs gate driving pulses in the order of $LX_1 \rightarrow RX_1 \rightarrow LX_2 \rightarrow RX_2 \rightarrow . . . , \rightarrow LX_{n-1} \rightarrow RX_{n-1} \rightarrow LX_n \rightarrow RX_n$ to the gate lines 5 and 6 according to the output enable signal OE.

By exercising the control as above, the first liquid crystal display panel 3 and the second liquid crystal display panel 8, by commonly using the source driver 2 and drain lines 4, can display different images on each of the first and second liquid crystal display panels 3 and 8 at the same time.

Thus, according to the liquid crystal display device 102 of the third embodiment, in each of the first liquid crystal display panel 3 and the second liquid crystal display panel 8, though these two liquid crystal display panels 3 and 8 commonly use the source driver 2 and drain lines 4, simultaneous display of two images in each of the two liquid crystal display panels 3 and 8 is made possible.

Fourth Embodiment

Figure 8:
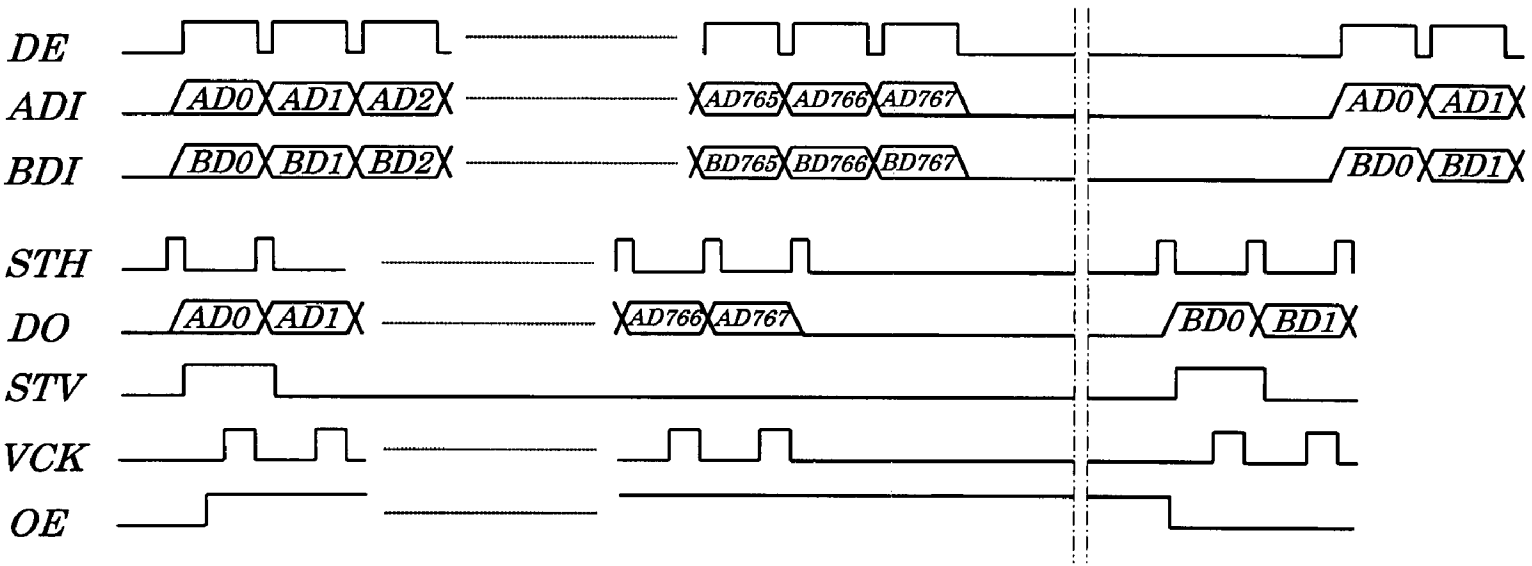
FIG. 8 is a timing chart explaining operations of a liquid crystal display device according to a fourth embodiment of the present invention.

FIG. 8 is a timing chart for explaining operations of a liquid crystal display device of the fourth embodiment of the present invention. The configurations of the liquid crystal display device and gate driver of the fourth embodiment are the same as those shown in FIGS. 5 and 6, however, differ from those in the third embodiment in that data is written alternately in first and second liquid crystal display panels 3 and 8 in a frame period.

Operations of the liquid crystal display device of the embodiment are described by referring to FIG. 8. FIG. 8 shows operations of the liquid crystal display device of the fourth embodiment by using timing with which two pieces of liquid crystal display panels each providing 1024×768 resolution display images.

An image data signal DO is controlled, as shown in FIG. 8, so that image data AD0 to AD767 to be used in the first liquid crystal display panel 3 and image data BD0 to BD767 to be used in the second liquid crystal display panel 8 are output consecutively. Source driver 2, when receiving the input image data signal DO, outputs image data in the order of AD0→AD1, → . . . , →AD766→AD767→BD0→BD1→ . . . , →BD766→BD767 to the drain lines 4.

In order to realize correct displaying of the frame-by-frame image data AD0→AD1→, . . . , → AD766→AD767→BD0→BD1, →, BD766→BD767 all being output from the source driver 2 to the drain lines 4, on each of the first liquid crystal display panel 3 and second liquid crystal display panel 8, control is exercised so that a logical value of an output enable signal OE in every one frame period is reversed. Then, gate driving pulses are output in the order of $LX_1 \rightarrow LX_2 \rightarrow, . . . , \rightarrow LX_{n-1} \rightarrow LX_n \rightarrow RX_1 \rightarrow RX_2 \rightarrow . . . , \rightarrow RX_{n-1} \rightarrow RX_n$ to the gate lines 5 and 6 according to the output enable signal OE input to gate driver 10.

By exercising the control as above, the first liquid crystal display panel 3 and the second liquid crystal display panel 8, by commonly using the source driver 2 and drain lines 4, can display different images in each of the first and second liquid crystal display panels 3 and 8 at the same time.

Thus, according to the liquid crystal display device of the fourth embodiment, in each of the first liquid crystal display panel 3 and the second liquid crystal display panel 8, though these two liquid crystal display panels 3 and 8 commonly use the source driver 2 and drain lines 4, simultaneous display of two images in each of the two liquid crystal display panels 3 and 8 is made possible.

It is apparent that the present invention is not limited to the above embodiments but may be changed and modified without departing from the scope and spirit of the invention. For example, the resolution of the liquid crystal display panels 3 and 8 is not limited, to 1024 pixels×768 pixels and may be 1280 pixels×1024 pixels, 1280 pixels×768 pixels, or the like.

The liquid crystal display devices according to the present invention can be suitably applied to portable phones of a front and rear simultaneous displaying format, however, may be widely used for various portable information devices of a front and rear simultaneous displaying configuration having a plurality of displaying sections.

What is claimed is:

1. A liquid crystal display device comprising:

a plurality of liquid crystal display panels;

a timing controller to control outputting timing of a plurality of image data signals, said image data signals each being fed to a corresponding one of said plurality of liquid crystal display panels;

a source driver to output image data, gate line by gate line, to a plurality of drain lines commonly connected between said source driver and each of said plurality of liquid crystal display panels according to output timing control exercised by said timing controller; and a plurality of gate drivers each corresponding to one of said plurality of liquid crystal display panels, said gate drivers each outputting sequentially gate driving pulses to a plurality of the gate lines connected to the corresponding liquid crystal display panel according to inputting of first and second signals, the first signal, which is fed sequentially to said plurality of gate drivers in a cascaded manner, providing instructions for a start of outputting of the corresponding image data signal, which is transmitted from said timing controller, to be fed to the corresponding liquid crystal display panel, and the second signal, which is fed to said plurality of gate drivers in a parallel manner, controlling an inputting period of frame by frame image data, which makes up the corresponding image data signal;

wherein a plurality of the frame-by-frame image data, which makes up said plurality of image data signals, each is sequentially switched in order of inputting of said plurality of the frame-by-frame image data and is output to the drain lines connected to the corresponding liquid crystal display panel.

2. A liquid crystal display device comprising:

a plurality of liquid crystal display panels;

a timing controller to control outputting timing of a plurality of image data signals, said image data signals each being fed to a corresponding one of said plurality of liquid crystal display panels;

a source driver to output image data, gate line by gate line, to a plurality of drain lines commonly connected between said source driver and each of said plurality of liquid crystal display panels according to output timing control exercised by said timing controller; and a gate driver being commonly used by said plurality of liquid crystal display panels and outputting sequentially gate driving pulses to a plurality of the gate lines connected to a designated liquid crystal display panel according to inputting of first, second, and third signals, the first signal providing instructions for a start of outputting of the corresponding image data signal, which is transmitted from said timing controller, to be fed to the corresponding liquid crystal display panel, the second signal controlling an inputting period of the gate line-by-gate line image data, which makes up the corresponding image data signal, the third signal designating one of said plurality of liquid crystal display panels as liquid crystal display panel the to which said image data is output;

wherein a plurality of the gate line-by-gate line image data, which makes up said plurality of image data signals, each is sequentially switched in order of inputting of said plurality of the gate line-by-gate line image data and is output to the corresponding drain line connected to the corresponding liquid crystal display panel.

3. A liquid crystal display device comprising:

a plurality of liquid crystal display panels;

a timing controller to control outputting timing of a plurality of image data signals, said image data signals each being fed to a corresponding one of said plurality of liquid crystal display panels;

a source driver to output image data, gate line by gate line, to a plurality of drain lines commonly connected between said source driver and each of said plurality of liquid crystal display panels according to output timing control exercised by said timing controller; and a gate driver being commonly used by said plurality of liquid crystal display panels and outputting sequentially gate driving pulses to a plurality of the gate lines connected to a designated liquid crystal display panel according to inputting of first, second, and third signals, the first signal providing instructions for a start of outputting of the corresponding image data signal, which is transmitted from said timing controller, to be fed to the corresponding liquid crystal display panel, the second signal controlling an inputting period of the frame-by-frame image data, which makes up the corresponding image data signal, the third signal designating one of said plurality of liquid crystal display panels as liquid crystal display panel the to which said image data is output;

wherein a plurality of the frame-by-frame image data, which makes up said plurality of image data signals, each is sequentially switched in order of inputting of said plurality of the frame-by-frame image data and is output to the drain lines connected to the corresponding liquid crystal display panel.

4. A method for driving a liquid crystal display device comprising: a plurality of liquid crystal display panels that are connected to each other by common drain lines, and a plurality of gate drivers being cascaded, said gate drivers each corresponding to one of said plurality of liquid crystal display panels, and controlling a plurality of the gate lines connected to the corresponding liquid crystal display panel, the method comprising the steps of:

outputting image data beginning with head data, frame by frame, to the plurality of drain lines connected to said plurality of liquid crystal display panels, in a manner to control a plurality of image data so as to be input sequentially to the corresponding liquid crystal display panel in one line period;

outputting sequentially gate driving pulses to said plurality of the gate lines of said plurality of liquid crystal display panels in a cascaded manner; and feeding a signal to said plurality of gate drivers in a parallel manner, wherein a plurality of the frame-by-frame image data, which makes up said plurality of image data signals, each is sequentially switched in order of inputting of said plurality of the frame-by-frame image data and is output to the drain lines connected to the corresponding liquid crystal display panel.

5. A method for driving a liquid crystal display device comprising: a plurality of liquid crystal display panels that are connected to each other by a plurality of common drain lines, and a gate driver being commonly used by said plurality of liquid crystal display panels, and controlling a plurality of the gate lines connected to said plurality of liquid crystal display panels, the method comprising the steps of:

outputting image data beginning with head data, gate line by gate line, to the plurality of drain lines connected to said plurality of liquid crystal display panels, in a manner to control so as to be input sequentially to the corresponding liquid crystal display panel in an inputting period of the number of the gate lines being equal to the number of said plurality of liquid crystal display panels;

designating one of said plurality of liquid crystal display panels as liquid crystal display panel the to which said image data is output; and outputting sequentially gate driving pulses to said plurality of the gate lines of the designated liquid crystal display panels; and wherein a plurality of the gate line-by-gate line image data, which makes up a plurality of image data signals, each is sequentially switched in order of inputting of said plurality of the gate line-by-gate line image data and is output to the corresponding drain line connected to the corresponding liquid crystal display panel.

6. A method for driving a liquid crystal display device comprising: a plurality of liquid crystal display panels that are connected to each other by a plurality of common drain lines, and a gate driving means being commonly used by said plurality of liquid crystal display panels, and controlling a plurality of the gate lines connected to said plurality of liquid crystal display panels, the method comprising the steps of:

outputting image data beginning with head data, frame by frame, to the plurality of drain lines connected to said plurality of liquid crystal display panels, in a manner to control a plurality of image data so as to be input sequentially to the corresponding liquid crystal display panel in one line period;

designating one of said plurality of liquid crystal display panels as liquid crystal display panel the to which said image data is output; and outputting sequentially gate driving pulses to said plurality of the gate lines of the designated liquid crystal display panels; and wherein a plurality of the frame-by-frame image data, which makes up said plurality of image data signals, each is sequentially switched in order of inputting of said plurality of the frame-by-frame image data and is output to the drain lines connected to the corresponding liquid crystal display panel.

7. A liquid crystal display device comprising:

a plurality of liquid crystal display panels;

a timing controlling means to control outputting timing of a plurality of image data signals, said image data signals each being fed to a corresponding one of said plurality of liquid crystal display panels;

a source driving means to output image data, gate line by gate line, to a plurality of drain lines commonly connected between said source driving means and each of said plurality of liquid crystal display panels according to output timing control exercised by said timing controlling means; and a plurality of gate driving means each corresponding to one of said plurality of liquid crystal display panels, said plurality of gate driving means each outputting sequentially gate driving pulses to a plurality of the gate lines connected to the corresponding liquid crystal display panel according to inputting of first and second signals, the first signal, which is fed sequentially to said plurality of gate driving means in a cascaded manner, providing instructions for a start of outputting of the corresponding image data signal, which is transmitted from said timing controlling means, to be fed to the corresponding liquid crystal display panel, and the second signal, which is fed to said plurality of gate driving means in a parallel manner, controlling an inputting period of frame by frame image data, which makes up the corresponding image data signal;

wherein a plurality of the frame-by-frame image data, which makes up said plurality of image data signals, each is sequentially switched in order of inputting of said plurality of the frame-by-frame image data and is output to the drain lines connected to the corresponding liquid crystal display panel.

8. A liquid crystal display device comprising:

a plurality of liquid crystal display panels;

a timing controlling means to control outputting timing of a plurality of image data signals, said image data signals each being fed to a corresponding one of said plurality of liquid crystal display panels;

a source driving means to output image data, gate line by gate line, to a plurality of drain lines commonly connected between said source driving means and each of said plurality of liquid crystal display panels according to output timing control exercised by said timing controlling means; and a gate driving means being commonly used by said plurality of liquid crystal display panels and outputting sequentially gate driving pulses to a plurality of the gate lines connected to a designated liquid crystal display panel according to inputting of first, second, and third signals, the first signal providing instructions for a start of outputting of the corresponding image data signal, which is transmitted from said timing controlling means, to be fed to the corresponding liquid crystal display panel, the second signal controlling an inputting period of the gate line-by-gate line image data, which makes up the corresponding image data signal, the third signal designating one of said plurality of liquid crystal display panels as liquid crystal display panel the to which said image data is output;

wherein a plurality of the gate line-by-gate line image data, which makes up said plurality of image data signals, each is sequentially switched in order of inputting of said plurality of the gate line-by-gate line image data and is output to the corresponding drain line connected to the corresponding liquid crystal display panel.

9. A liquid crystal display device comprising:

a plurality of liquid crystal display panels;

a timing controlling means to control outputting timing of a plurality of image data signals, said image data signals each being fed to a corresponding one of said plurality of liquid crystal display panels;

a source driving means to output image data, gate line by gate line, to a plurality of drain lines commonly connected between said source driving means and each of said plurality of liquid crystal display panels according to output timing control exercised by said timing controlling means; and a gate driving means being commonly used by said plurality of liquid crystal display panels and outputting sequentially gate driving pulses to a plurality of the gate lines connected to a designated liquid crystal display panel according to inputting of first, second, and third signals, the first signal providing instructions for a start of outputting of the corresponding image data signal, which is transmitted from said timing controlling means, to be fed to the corresponding liquid crystal display panel, the second signal controlling an inputting period of the frame-by-frame image data, which makes up the corresponding image data signal, the third signal designating one of said plurality of liquid crystal display panels as liquid crystal display panel the to which said image data is output;

wherein a plurality of the frame-by-frame image data, which makes up said plurality of image data signals, each is sequentially switched in order of inputting of said plurality of the frame-by-frame image data and is output to the drain lines connected to the corresponding liquid crystal display panel.

10. A liquid crystal display device comprising:

a plurality of liquid crystal display panels;

a timing controller to control outputting timing of a plurality of image data signals, said image data signals each being fed to a corresponding one of said plurality of liquid crystal display panels;

a source driver to output image data, gate line by gate line, to a plurality of drain lines commonly connected between said source driver and each of said plurality of liquid crystal display panels according to output timing control exercised by said timing controller; and a plurality of gate drivers each corresponding to one of said plurality of liquid crystal display panels, said gate drivers each outputting sequentially gate driving pulses to a plurality of the gate lines connected to the corresponding liquid crystal display panel according to inputting of first and second signals, the first signal providing instructions for a start of outputting of the corresponding image data signal, which is transmitted from said timing controller, to be fed to the corresponding liquid crystal display panel, and the second signal controlling an inputting period of the gate line-by-gate line image data, which makes up the corresponding image data signal;

wherein a plurality of the gate line-by-gate line image data, which makes up said plurality of image data signals, each is sequentially switched in order of inputting of said plurality of the gate line-by-gate line image data and is output to the corresponding drain line connected to the corresponding liquid crystal display panel.

11. A method for driving a liquid crystal display device comprising: a plurality of liquid crystal display panels that are connected to each other by a plurality of common drain lines, and a plurality of gate drivers each corresponding to one of said plurality of liquid crystal display panels, and controlling a plurality of the gate lines connected to the corresponding liquid crystal display panel, the method comprising the steps of:

outputting image data beginning with head data, gate line by gate line, to the plurality of drain lines connected to said plurality of liquid crystal display panels, in a manner to control so as to be input sequentially to the corresponding liquid crystal display panel in an inputting period of the number of the gate lines being equal to the number of said plurality of liquid crystal display panels; and outputting sequentially gate driving pulses to said plurality of the gate lines of said plurality of liquid crystal display panels; and wherein a plurality of the gate line-by-gate line image data, which makes up a plurality of image data signals, each is sequentially switched in order of inputting of said plurality of the gate line-by-gate line image data and is output to the corresponding drain line connected to the corresponding liquid crystal display panel.

12. A liquid crystal display device comprising:

a plurality of liquid crystal display panels;

a timing controlling means to control outputting timing of a plurality of image data signals, said image data signals each being fed to a corresponding one of said plurality of liquid crystal display panels;

a source driving means to output image data, gate line by gate line, to a plurality of drain lines commonly connected between said source driving means and each of said plurality of liquid crystal display panels according to output timing control exercised by said timing controlling means; and a plurality of gate driving means each corresponding to one of said plurality of liquid crystal display panels, said plurality of gate driving means each outputting sequentially gate driving pulses to a plurality of the gate lines connected to the corresponding liquid crystal display panel according to inputting of first and second signals, the first signal providing instructions for a start of outputting of the corresponding image data signal, which is transmitted from said timing controlling means, to be fed to the corresponding liquid crystal display panel, and the second signal controlling an inputting period of the gate line-by-gate line image data, which makes up the corresponding image data signal;

wherein a plurality of the gate line-by-gate line image data, which makes up said plurality of image data signals, each is sequentially switched in order of inputting of said plurality of the gate line-by-gate line image data and is output to the corresponding drain line connected to the corresponding liquid crystal display panel.

* * * * *